US007305770B2

(12) United States Patent
Critelli et al.

(10) Patent No.: US 7,305,770 B2
(45) **Date of Patent: *Dec. 11, 2007**

(54) RELEASABLE BLADE LOCKING MECHANISM FOR UTILITY KNIFE

(75) Inventors: James M. Critelli, Fuquay-Varina, NC (US); Stephen E. Donelson, Raleigh, NC (US)

(73) Assignee: Cooper Brands, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/513,449

(22) Filed: Aug. 31, 2006

(65) Prior Publication Data

US 2006/0288586 A1 Dec. 28, 2006

Related U.S. Application Data

(63) Continuation of application No. 11/108,322, filed on Apr. 18, 2005, now Pat. No. 7,107,688.

(51) Int. Cl.
*B26B 1/08* (2006.01)

(52) U.S. Cl. ..... 30/162; 30/335

(58) Field of Classification Search ..... 30/125, 30/162, 335

See application file for complete search history.

(56) References Cited

U.S. PATENT DOCUMENTS

| | | | |
|---|---|---|---|
| 3,192,624 | A | 7/1965 | Gringer |
| 3,577,637 | A | 5/1971 | Braginetz |
| 3,660,896 | A | 5/1972 | Umholtz |
| 3,845,554 | A | 11/1974 | Joanis |
| 3,872,591 | A | 3/1975 | Quenot |
| 3,964,162 | A | 6/1976 | Gerson |
| 4,009,905 | A | 3/1977 | Bejeannin |
| D249,325 | S | 9/1978 | Rollband |
| 4,170,062 | A | 10/1979 | Machida |
| 4,226,020 | A | 10/1980 | Quenot |
| 4,277,888 | A | 7/1981 | Szabo |
| RE30,733 | E | 9/1981 | Quenot |
| 4,517,741 | A | 5/1985 | Castelluzzo |
| 4,575,940 | A | 3/1986 | Wenzel |
| 4,586,256 | A | 5/1986 | Weimann |
| 4,604,805 | A | 8/1986 | Krieger |
| 4,621,425 | A | 11/1986 | Stoutenberg |
| 4,663,845 | A | 5/1987 | Weimann |
| 4,761,882 | A | 8/1988 | Silverstein |
| 4,813,132 | A | 3/1989 | Castelluzzo |
| 4,868,985 | A | 9/1989 | Rehm |

(Continued)

*Primary Examiner*—Hwei-Siu C. Payer
(74) *Attorney, Agent, or Firm*—Coats & Bennett, P.L.L.C.

(57) ABSTRACT

A utility knife has a blade carriage having a blade-receiving bay and moveable relative to the knife's housing to move a cutting blade disposed in the bay from a retracted position to a deployed position. A locking mechanism is operative to releasably couple the cutting blade to the carriage and may include a lock plate having an blade-engagement element and moveable by non-pivoting, generally vertical displacement between a locked position and an unlocked position. An actuator engages the locking mechanism and moves the locking mechanism from the locked position to the unlocked position. The actuator may directly contact an underside of a protrusion of the locking mechanism, may be moveably mounted on the sidewall to which the bay opens toward, may be prevented from being moved as far when the actuator is not aligned with the locking mechanism, or any combination thereof.

15 Claims, 6 Drawing Sheets

U.S. PATENT DOCUMENTS 4,941,260 A 7/1990 Castelluzzo
5,005,290 A 4/1991 Gilbert
5,025,558 A 6/1991 Gilbert
5,031,322 A 7/1991 Jacoff
D319,378 S 8/1991 Wilcox
5,042,154 A 8/1991 Gilbert
5,086,562 A 2/1992 Jacoff
5,093,993 A 3/1992 Nishiyama
5,093,994 A 3/1992 Karas
5,099,578 A 3/1992 Jan
5,121,544 A 6/1992 Gilbert
5,131,149 A 7/1992 Thompson
5,168,630 A 12/1992 Weber
5,251,380 A 10/1993 Craig
5,301,428 A 4/1994 Wilcox
5,303,469 A 4/1994 Yin-Han
D349,227 S 8/1994 Ragland
D352,881 S 11/1994 Schmidt
5,386,632 A 2/1995 Schmidt
5,404,645 A 4/1995 Janser
5,406,707 A 4/1995 Owens
5,426,855 A 6/1995 Keklak
5,435,062 A 7/1995 Huang
5,495,670 A 3/1996 Quinn
5,509,205 A 4/1996 Ragland
5,581,890 A 12/1996 Schmidt
5,613,300 A 3/1997 Schmidt
5,644,843 A 7/1997 Young
5,715,605 A 2/1998 Nadeau
5,720,105 A 2/1998 Gates
5,813,121 A 9/1998 Gringer
5,875,551 A 3/1999 Huang
5,878,501 A 3/1999 Owens
5,906,050 A 5/1999 Gilbert
5,909,930 A 6/1999 Ragland
5,950,311 A 9/1999 Huang
5,960,545 A 10/1999 Shepherd
5,966,817 A 10/1999 Lee
6,000,136 A 12/1999 Owens
D420,270 S 2/2000 Martone
6,044,562 A 4/2000 Dillenbeck
6,101,721 A 8/2000 Medhurst
6,148,522 A 11/2000 Dobandi
6,161,290 A 12/2000 Takamasa
D438,084 S 2/2001 Khachatoorian
6,192,589 B1 2/2001 Martone
D439,492 S 3/2001 Martone
D440,858 S 4/2001 Gilbert
6,233,830 B1 5/2001 Lamond
6,249,975 B1 6/2001 Lin
D445,662 S 7/2001 Huang
6,260,279 B1 7/2001 Apolinski
6,314,646 B1 11/2001 Schmidt
6,330,749 B1 12/2001 Khachatoorian
6,336,271 B1 1/2002 Rider
D454,042 S 3/2002 Hsu
6,357,120 B1 3/2002 Khachatoorian
6,374,496 B1 4/2002 Hsu
6,374,497 B1 4/2002 Sun
D458,526 S 6/2002 Budrow
D460,908 S 7/2002 Sun
6,415,514 B1 7/2002 Chun
D462,250 S 9/2002 Ping
6,446,340 B1 9/2002 Ping
6,449,850 B1 9/2002 Gilbert
6,502,311 B1 1/2003 Khachatoorian
6,513,246 B2 2/2003 Ping
6,546,632 B2 4/2003 Gilbert
6,550,144 B1 4/2003 Berns
6,553,674 B1 4/2003 Budrow
D476,214 S 6/2003 Hsu
D478,493 S 8/2003 Martone
6,678,958 B1 1/2004 Budrow
6,735,872 B1 5/2004 Chang
6,742,260 B1 6/2004 Hsu
6,742,261 B2 6/2004 Ho
6,775,911 B2 8/2004 Tremblay
6,802,126 B2 10/2004 Huang
6,813,833 B2 11/2004 Saunders
6,829,827 B2 12/2004 Tseng
7,107,688 B1 * 9/2006 Critelli et al. ..... 30/162
2002/0029480 A1 3/2002 Lin
2003/0037444 A1 2/2003 Chunn
2003/0154605 A1 8/2003 Chao

* cited by examiner

RELEASABLE BLADE LOCKING MECHANISM FOR UTILITY KNIFE

This is a continuation of U.S. patent application Ser. No. 11/108,322, filed 18 Apr. 2005, now U.S. Pat. No. 7,107, 688, the entirety of which is incorporated herein by reference.

BACKGROUND OF THE INVENTION

The present invention is directed generally to utility knives, and more particularly to a utility knife having a releasable blade locking mechanism.

Modern utility knives typically include a housing, a moveable blade carriage, and a cutting blade. The blade carriage is mounted in the housing so as slide back and forth inside the housing. The cutting blade is coupled to the blade carriage so as to move between an extended or deployed cutting position (carriage forward) and a retracted position (carriage back). The cutting blade typically has a trapezoid shape with a razor sharp cutting edge along the long lower side and two small U-shaped notches along an opposing shorter upper side for mating the cutting blade to the blade carriage.

In use, the sharp edge of the cutting blade may become dulled, or the blade may break, or the blade may otherwise need to be replaced. As such, it is common for utility knives to allow the blade to be replaced. In very simple utility knives, the housing may be formed of two halves that are joined together by a central screw. Replacement of the blade in such devices requires the screw to be removed, the housing halves separated to expose the blade carriage, removal and replacement of the blade, and then re-assembly of the housing. Such an arrangement is shown, for example, in U.S. Pat. Nos. 5,099,578 and 3,192,624. Other utility knives use modified versions of this concept, with housing halves that pivot with respect to one another, or other means to hold the housing halves together. Nevertheless, the manipulation of the housing required to change the cutting blades is less than ideal with such designs. Accordingly, some designs have been proposed that use a "quick release" mechanism that allows the cutting blade to be replaced via the front slit in the housing. Examples of such designs are shown in U.S. Pat. Nos. 6,829,827 and 6,553,674. However, even these quick-release mechanisms have proven less than ideal, and there remains a need for alternative utility knife designs that allow for easy cutting blade replacement.

SUMMARY OF THE INVENTION

A utility knife has a blade carriage having a blade-receiving bay and moveable relative to the knife's housing to move a cutting blade disposed in the bay from a retracted position to a deployed position. A locking mechanism is operative to releasably couple the cutting blade to the carriage and may include a lock plate having an blade-engagement element and moveable by non-pivoting, generally vertical displacement between a locked position and an unlocked position. An actuator engages the locking mechanism and moves the locking mechanism from the locked position to the unlocked position. The actuator may directly contact an underside of a protrusion of the locking mechanism, may be moveably mounted on the sidewall to which the bay opens toward, may be prevented from being moved as far when the actuator is not aligned with the locking mechanism, or any combination thereof.

Thus, in one embodiment, the present invention is directed to a utility knife for holding a cutting blade having at least one retaining notch therein comprising: an outer housing having a forward opening; a blade carriage having a blade-receiving bay; the blade carriage moveable in the housing to move the cutting blade disposed in the bay from a retracted position to a deployed position, the cutting blade extending through the forward opening in the deployed position; a locking mechanism operative to releasably couple the cutting blade to the carriage; the locking mechanism connected to the carriage for movement therewith relative to the housing; the locking mechanism moveable between a locked position operative to couple the cutting blade to the carriage for movement therewith and an unlocked position wherein the cutting blade can be removed from the carriage; the locking mechanism biased toward the locked position; the locking mechanism having a protrusion; the protrusion configured to engage the cutting blade's retaining notch in the locked position and disengage from the retaining notch in the unlocked position; the protrusion having an underside disposed toward the cutting blade when the cutting blade is disposed in the blade-receiving bay; and a first actuator moveably coupled to the housing and operative to engage with the underside of the protrusion and move the locking mechanism from the locked position to the unlocked position.

In another embodiment, the present invention provides a utility knife comprising: an outer housing having first and second lateral sidewalls and a forward opening; a blade carriage having a blade-receiving bay opening toward the first sidewall; the blade carriage moveable in the housing to move a cutting blade disposed in the bay from a retracted position to a deployed position, the cutting blade extending through the forward opening in the deployed position; a locking mechanism operative to releasably couple the cutting blade to the carriage; the locking mechanism connected to the carriage for movement therewith relative to the housing; the locking mechanism moveable generally vertically between a locked position operative to couple the cutting blade to the carriage for movement therewith and an unlocked position wherein the cutting blade can be removed from the carriage; the locking mechanism biased toward the locked position; and a first actuator moveably mounted to the first sidewall of the housing; the first actuator generally vertically moveable to engage the locking mechanism and move the locking mechanism from the locked position to the unlocked position.

In another embodiment, the present invention provides a utility knife comprising: an outer housing having a forward opening; a blade carriage having a blade-receiving bay; the blade carriage moveable in the housing to move a cutting blade disposed in the bay from a retracted position to a deployed position, the cutting blade extending through the forward opening in the deployed position; a locking mechanism operative to releasably couple the cutting blade to the carriage; the locking mechanism connected to the carriage for movement therewith relative to the housing; the locking mechanism moveable generally vertically between a locked position operative to couple the cutting blade to the carriage for movement therewith and an unlocked position wherein the cutting blade can be removed from the carriage; the locking mechanism biased toward the locked position; a first actuator moveable a first distance, when aligned with the locking mechanism, to engage the locking mechanism and move the locking mechanism from the locked position to the unlocked position; the first actuator moveable not more than a second distance when not aligned with the locking mechanism, the second distance shorter than the first distance.

In other embodiments, a utility knife having one or more of the features discussed above, in any combination, is provided, optionally with other features disclosed in the following description.

DETAILED DESCRIPTION OF THE INVENTION

In one illustrative embodiment, the present invention provides a utility knife having a novel releasable blade locking mechanism that allows the associated cutting blade to be replaced easily.

Figure 1:
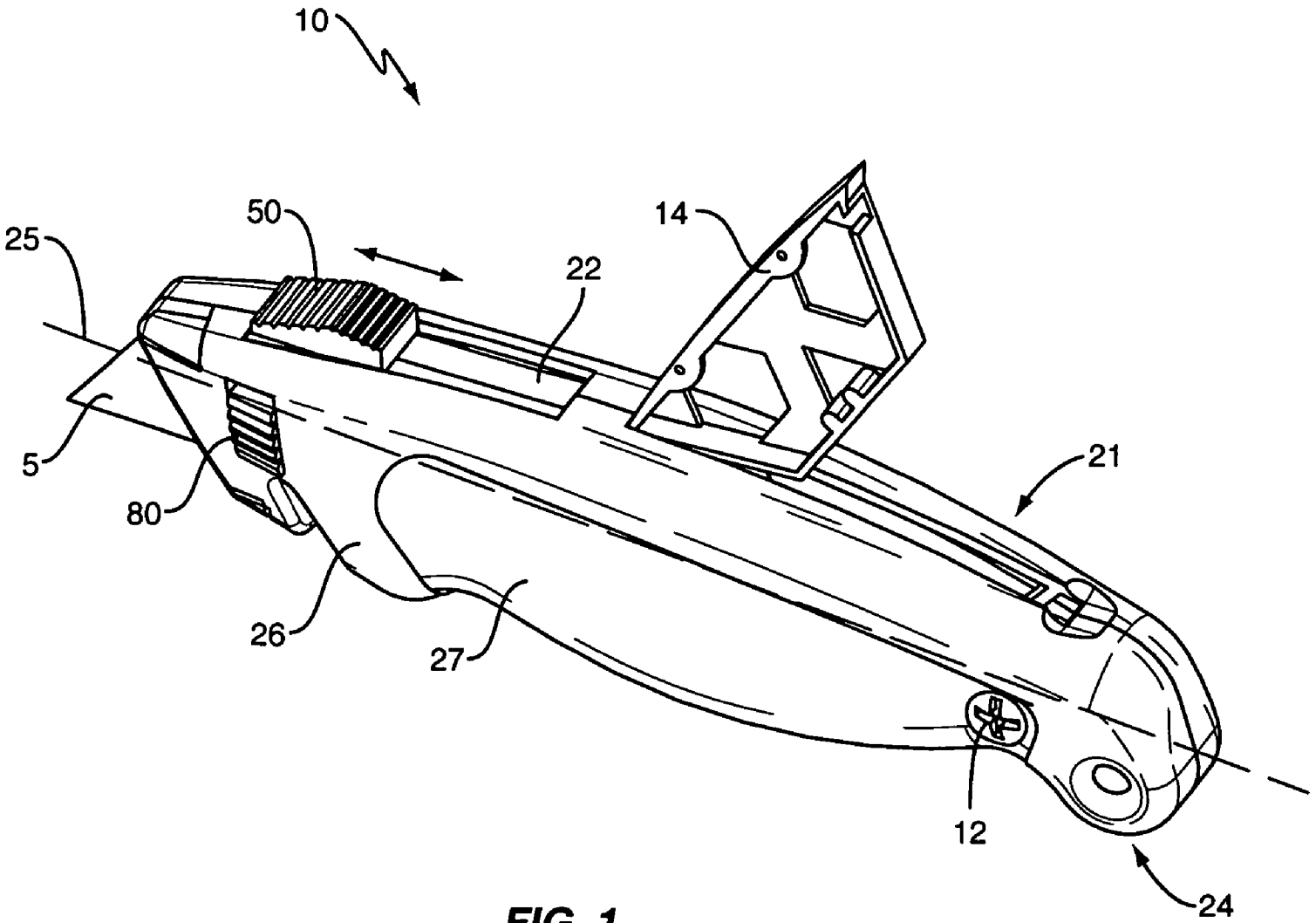
FIG. 1 is shows one embodiment of a utility knife constructed in accordance with the present invention with a blade storage arm moved to an open position.
Figure 2:
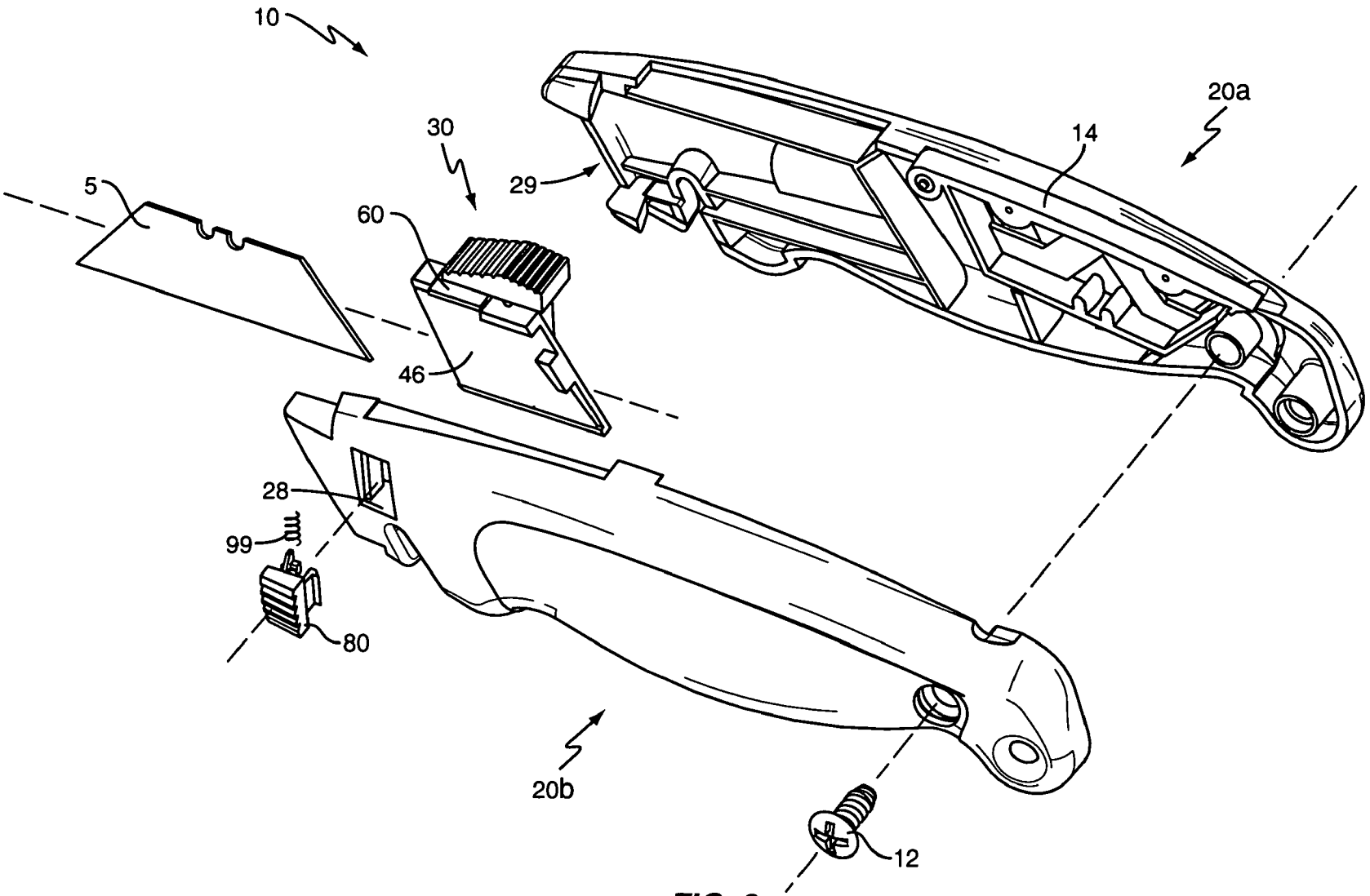
FIG. 2 shows an exploded view of the utility knife of FIG. 1 with the blade storage arm moved to a closed position.
Figure 3A:
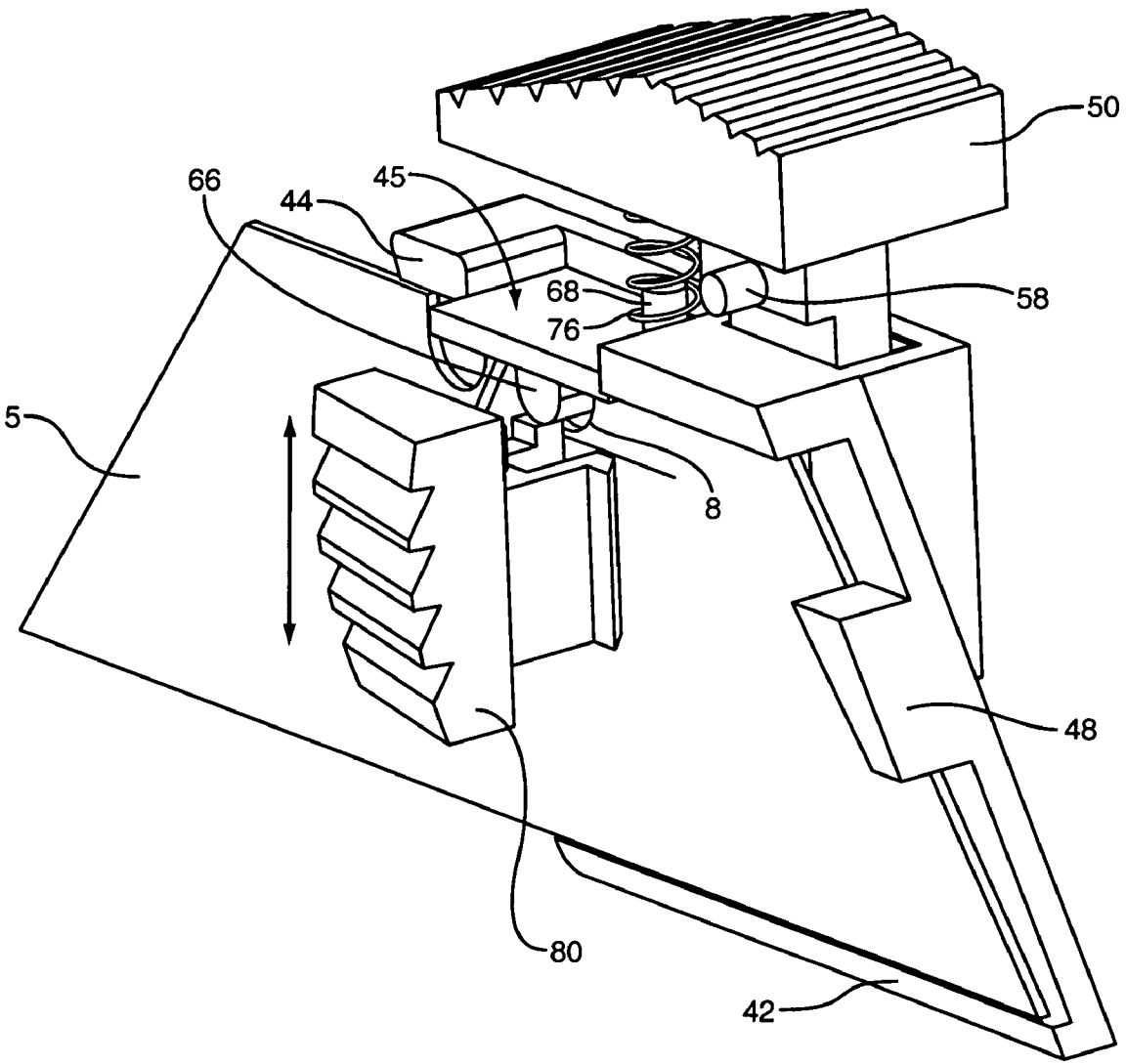
FIGS. 3A-3B shows some operational components of the embodiment of FIG. 1 in the locked position and the release position, respectively, with the housing removed.
Figure 3B:
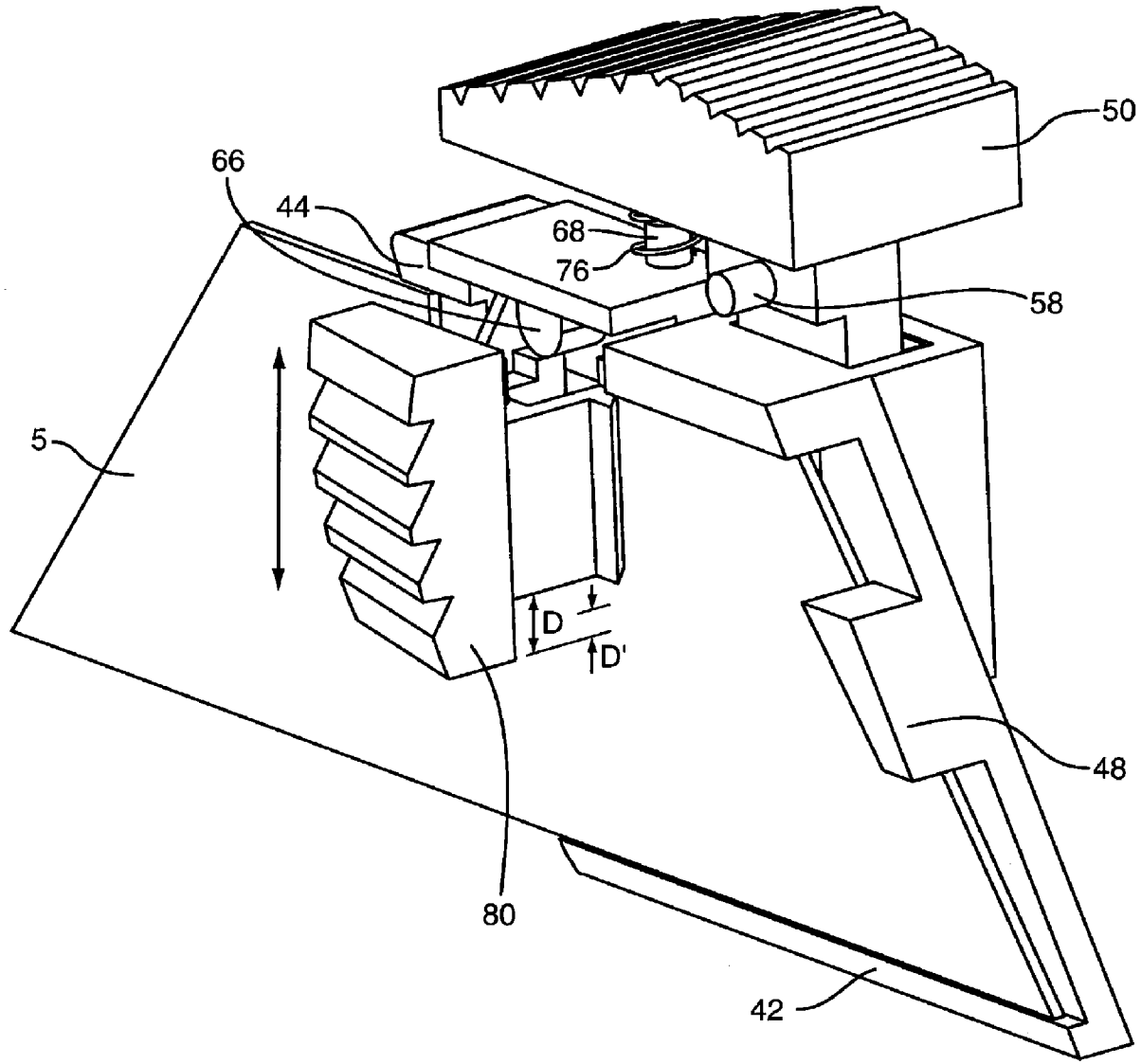
Figure 4:
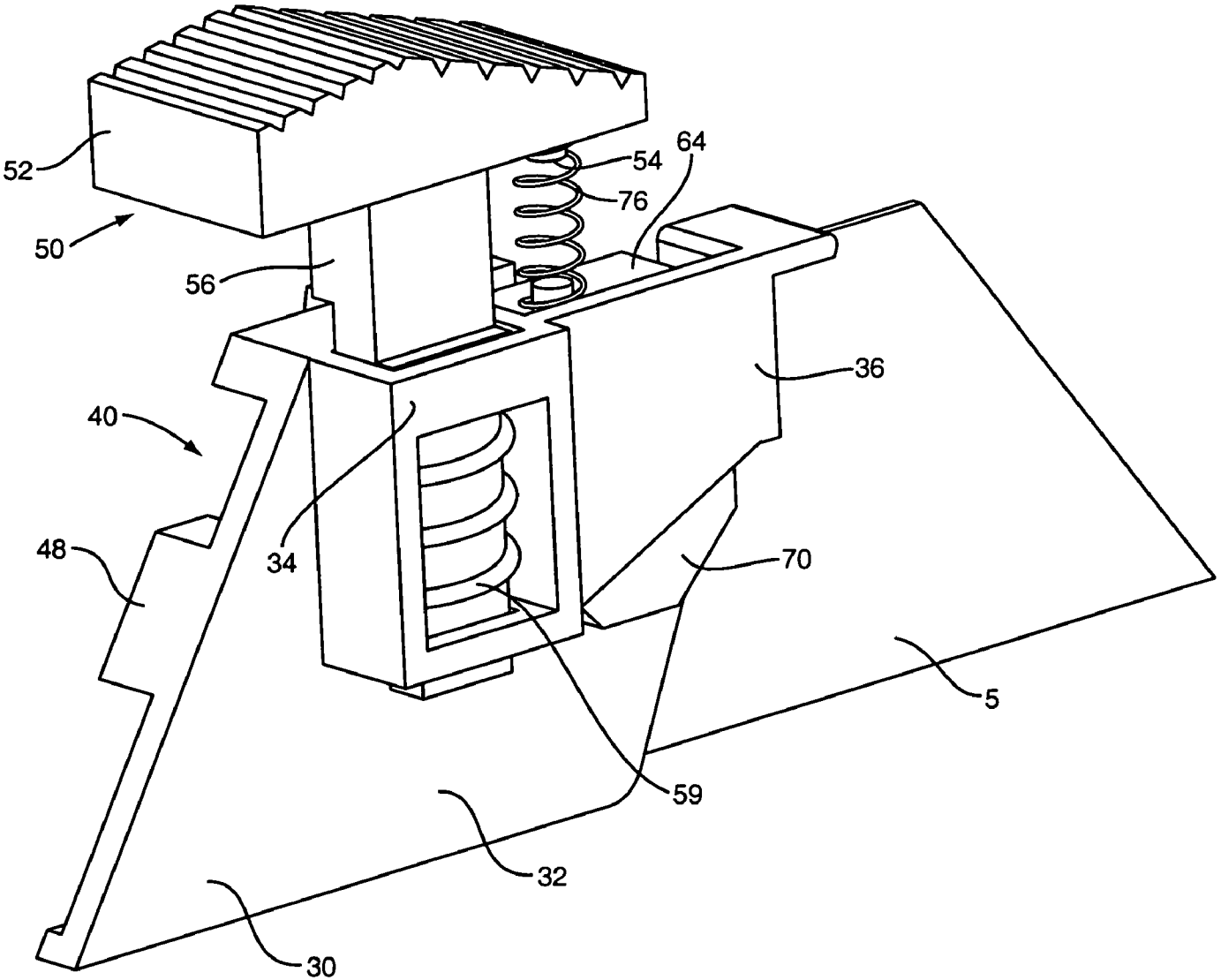
FIG. 4 shows a side perspective view of a blade mated to a blade carriage.
Figure 5:
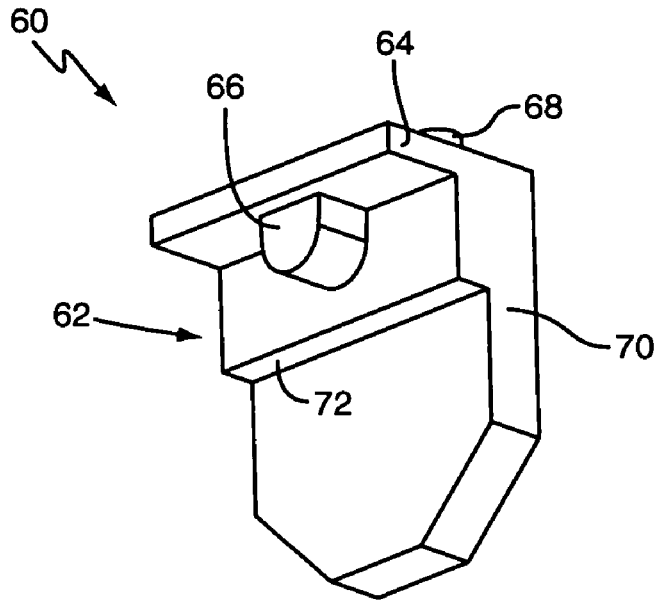
FIG. 5 shows a portion of a releasable locking mechanism.

As illustrated in FIG. 1, a utility knife, generally designated 10, is shown constructed according to the present invention. The knife 10 includes a housing 20, a blade carriage 30, and a locking mechanism 60 for coupling a cutting blade 5 to the blade carriage 30. The housing 20 includes a top 21, a bottom 24, and two lateral sidewalls 26 disposed between the top 21 and bottom 24. When viewed in cross-section, the sidewalls 26 are longer than the top 21 and bottom 24, and it is intended that the sidewalls 26 be disposed generally parallel to the planar side surfaces of the cutting blade 5. The housing 20 is generally elongate, with a theoretical midline 25 extending longitudinally front to back, midway between the sidewalls 26. The housing 20 may be formed of respective halves 20*a*, 20*b* that part generally along a plane that includes the midline 25 and are joined together by suitable means, such as by screws 12 or snap-fitting. The outer profile of the housing 20 should be shaped so as to fit comfortably in a user's hand. The housing 20 should be formed of a suitably strong material, such as steel or hard plastic, but the housing 20 may include areas 27 of soft elastomeric material on the exterior surfaces as is desired in order to increase comfort and/or to increase grip. As is conventional, the front portion of the housing 20 includes a front slit 29 sized so as to accommodate a cutting blade 5 extending therethrough.

The blade carriage 30 is slidably disposed in the housing 20. The blade carriage 30 includes a main body 32 defining a blade-receiving bay 40 and a carriage positioning actuator 50. The blade-receiving bay 40 is adapted to accept and support the cutting blade 5. While a wide variety of configurations for blade-receiving bay 40 are possible, the blade-receiving bay 40 typically has a generally U-shaped profile opening to the side (typically, the left side when viewed from the rear), with a vertical retaining wall 46, a bottom support wall 42, and a top retaining wall 44. When the cutting blade 5 is mated to carriage 30, a rearward portion of the cutting edge of blade 5 rests against the bottom support wall 42, the generally planar side of the blade 5 rests against retaining wall 46, and the upper edge of the blade 5 is disposed proximate the upper retaining wall 44. The carriage positioning actuator 50 mounts to a rearward portion of the blade carriage main body 32 and typically comprises a spring biased button having a cap 52 and a post 56. The post 56 extends through a longitudinal slot 22 formed in the housing top 21, and the cap 52 resides outside the housing 20 or in a recess in the housing top 21. The post 56 includes a laterally extending pin 58 that engages with corresponding indentions (not shown) on the interior of the housing 20 proximate the slot 22. Depressing the cap 52 moves the pin 58 out of engagement with the indentions, and allows the carriage 30 to slide back and forth horizontally to the desired position relative to the housing 20. The lower portion of the post 56 is disposed in a retaining structure 34 formed on the carriage main body 32 and the biasing spring 59 for the carriage positioning actuator 50 may be disposed in this retaining structure 34 if desired. As the construction and general operation of blade carriages and positioning actuators are well known in the field of utility knives, further details are omitted herein for brevity.

The locking mechanism 60 is supported by, and travels with, the blade carriage 30. The locking mechanism includes a generally L-shaped lock plate 62 (locking means). The long leg 70 of the lock plate 62 extends generally parallel to retaining wall 46, on the side of the blade carriage 30 opposite the blade-receiving bay 40. The short leg 64 of the lock plate 62 extends generally perpendicular to the long leg 70. The upper retaining wall 44 of the blade-receiving bay 40 includes a gap 45, and the short leg 64 of the lock plate 62 extends laterally into this gap 45 so as to overlie an upper portion of the blade-receiving bay 40. A protrusion 66 extends downwardly from the underside of the short leg 64. This protrusion 66 is intended to engage one of the notches 8 on the cutting blade 5 so as to couple the cutting blade 5 to the blade carriage 30, as discussed further below, and therefore may be referred to as the locking protrusion. At least a portion of the upper side of the short leg 64 is positioned so as to underlie the cap 52 of the carriage positioning actuator 50 and a compression spring 76 extends therebetween to bias the lock plate 62 downward relative to the blade carriage 30. There may be small bosses 68, 54 on the top of the lock plate 62 and the underside of the cap 52 to aid in seating and retaining bias spring 76. The long leg 70 of lock plate 62 is advantageously relatively smooth on the outboard side (facing away from the blade-receiving bay 40), while the inboard side of the long leg 70 may be smooth, but advantageously includes a shoulder 72 that is intended to abut against the carriage 30 to limit the downward movement of the lock plate 62. The long leg 70 is slidably captured by a suitable retaining arm 36 on the outboard side of the blade carriage 30 so that the lock plate 62 moves in a non-pivoting fashion relative to the carriage 30, with the relevant displacement being in a generally vertical direction. Thus, the lock plate 62 moves horizontally with the blade carriage 30, but is allowed to move up and down vertically with respect to the blade carriage 30.

Figure 6:
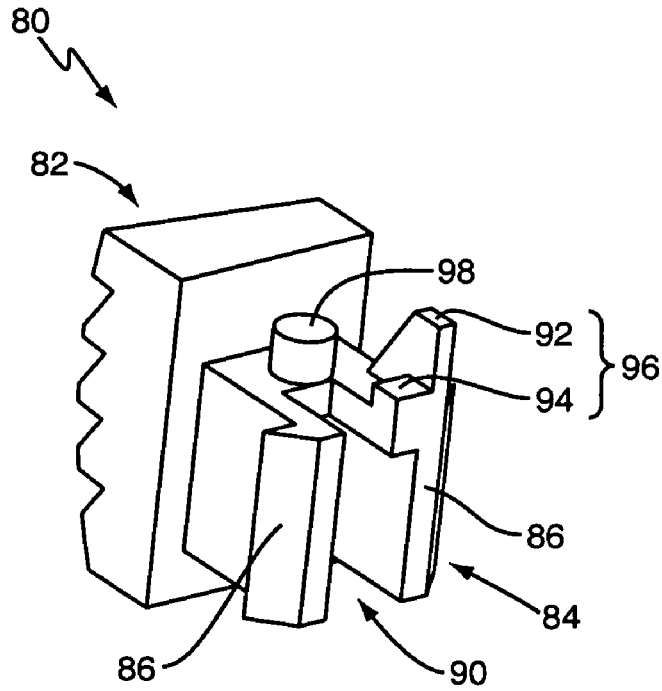
FIG. 6 shows a release actuator suitable for use with the present invention.

A release button 80 is mounted to one of the sidewalls 26 of the housing 20 and acts as an actuator for the locking mechanism 60. The button 80 includes an exterior portion 82 and an interior portion 84. The exterior portion 82 is accessible to the user and advantageously has the general shape of a rectangle, but other shapes are also possible. The outer surface of the exterior portion 82 may be textured, such as with ridges, raised dots, or the like. The exterior portion 82 of the button 80 advantageously fits at least partially in a recess in the housing's sidewall 26. The innermost wall of the recess includes an opening 28 to the interior of the housing 20, and the button 80 extends through this opening 28. Advantageously, this opening 28 is smaller than the exterior portion 82 of the button 80 so as to be concealed thereby. The interior portion 84 of the button 80 includes guide flanges 86 and a central engaging section 90. The guide flanges 86 engage the inside of the sidewall 26 to constrain the movement of the button 80 to be a sliding motion up and down, rather than back and forth or in and out. The central engaging section 90 of FIG. 6 includes a longer upright flange 92 disposed forward of a shorter platform 94. The tip of the upright flange 92 is intended to engage the underside of the short leg 64 of lock plate 62. The top of the platform 94 is intended to engage the underside of the locking protrusion 66. Thus, together, the top of the platform 94 and the tip of the flange 92 comprise an two-part engagement surface 96. Advantageously, the vertical distance between the tip of the flange 92 and the top of the platform 94 is such that they engage their respective portions of the lock plate 62 at the same time when the button 80 is displaced upward sufficiently. Further, the location of the flange 92 forward of the platform 94 allows button 80 to avoid interfering with the lock plate's forward movement to bring the blade carriage 30 into alignment with the button 80, but still provides redundant, and spaced apart, points of contact with the lock plate 62. It is believed that this spacing allows the lock plate 62 to be displaced by the button 80 with a minimum of binding, thereby insuring smooth operation. The central engaging section 90 may be braced as is desired to provide sufficient rigidity and support. The interior portion 84 may also include a short boss or pin 98 for accepting spring 99 that biases button 80 downward relative to housing 20. Thus, unless actuated by a user, the button 80 is in a lower, unengaged position, but can be slidably moved to an upper engaged position by a user. In moving from the unengaged position to the engaged position, the button 80 may advantageously move in a plane that is generally parallel to the sidewall 26. Thus, the button 80 in the engaged position is generally no closer to the midline 25 of the housing 20 than in the unengaged position, and advantageously farther away therefrom.

As is conventional, the blade carriage 30 is slidably disposed in the housing 20, and moves horizontally back and forth between a retracted position (back) and a deployed position (forward). The interaction of pin 58 on carriage positioning actuator 50 and the indentions on the interior of the housing 20 proximate the slot 22 allow for the carriage 30 to be retained in the desired horizontal position. Thus, the cutting blade 5, when coupled to the blade carriage 30, may be extended from the housing 20 for use and retracted into the housing 20 for storage.

The locking mechanism 60 acts to couple cutting blade 5 to blade carriage 30. In the locked position, lock plate 62 is in its downward position and locking protrusion 66 is disposed in one of the notches 8 in the upper edge of cutting blade 5. Thus, horizontal movement of the blade carriage 30 is conveyed via the lock plate 62 to the cutting blade 5, causing the carriage 30, locking mechanism 60, and blade 5 to all travel back and forth together. When it is desired to remove the blade 5, such as for replacement or to change cutting ends of the blade 5, the carriage 30 is moved forward to the fully deployed position. In this position, the lock plate 62 is generally aligned with the button 80, with the engaging surface 96 positioned underneath short leg 64. The user then slides the button 80 upward, bringing the engaging surface 96 into contact with the underside of the short leg 64 and forcing the lock plate 62 upward. Movement of the button 80 to the fully up position displaces the lock plate 62 upward enough so that the locking protrusion 66 on the underside of the short leg 64 is higher than the top of the cutting blade 5 (i.e., outside the notch 8), thereby decoupling the blade 5 from the carriage 30. The user may then simply pull the blade 5 out front slit 29 of housing 20. If desired, a new blade 5 may then be inserted into blade-receiving bay 40 of blade carriage 30 by inserting the blade 5 through front slit 29. When the blade 5 is sufficiently inserted, the user may release button 80, which is then urged downward by spring 99. The downward movement of the button 80 allows spring 76 to force lock plate 62 downward, so that locking protrusion 66 is thereby positioned in one of the cutting blade's notches 8, coupling the blade 5 to carriage 30. If desired, it may be advantageous for the blade-receiving bay 40 of blade carriage 30 to include a rear wall 48 positioned so as to facilitate alignment of the locking protrusion 66 with notch 8, although such is not required in all embodiments. The new blade 5 may then be retracted into the housing 20 in a conventional fashion.

As can be seen, the action of the locking mechanism 60 and release button 80 allow replacement of cutting blades 5 without requiring the utility knife's housing 20 to be disassembled and re-assembled. Instead, the simple vertical sliding movement of the release button 80, with the blade carriage 30 in the correct position, allows the cutting blade 5 to be very quickly changed with minimal effort. Indeed, in most embodiments, the release button 80 is disposed through the hole 28 in the housing sidewall 26 that faces the blade-receiving bay 40 of the blade carriage 30. This arrangement allows the blade 5 changing operation to be easily carried out by pressing the release button 80 with the user's thumb while the utility knife 10 is grasped in the conventional fashion in the user's hand (forward portion of the utility knife 10 extending out from thumb/forefinger area of the user's hand). Having the blade-receiving bay 40 thus oriented toward the user during the blade changing operation allows the user to more easily mate the blade 5 to carriage 30. Further, because most users are right-handed, the sidewall 26 of the housing 20 associated with the release button 80 is advantageously the left sidewall of housing 20 (when viewed from the rear of the utility knife).

It should be noted that the central surface 96 and guide flanges 86 of release button 80 are advantageously sized so as to avoid obstructing the blade-receiving bay 40. That is, they are spaced laterally from the plane of retaining wail 46 of blade-receiving bay 40 a sufficient distance to allow a cutting blade 5 to be easily inserted into the blade-receiving bay 40 via the front slit 29, and for the combination of the blade carriage 30 and the blade 5 to slide back and forth without interference. However, the lateral extent of the central engaging section 96 and/or guide flanges 86 may also be advantageously sized to butt against the upper retaining wall 44, or other portion of the blade carriage 30, when the release button 80 and the locking mechanism 60 are not properly horizontally aligned so as to prevent the substantial up/down movement of the release button 80 until the release button 80 and the locking mechanism 60 are properly horizontally aligned. Thus, the release button 80 is limited to a relatively smaller movement distance D' when the release button 80 and the locking mechanism 60 are not properly horizontally aligned, but allowed to move a relatively larger movement distance D when the release button 80 and the locking mechanism 60 are aligned.

In some embodiments, the utility knife 10 may include a storage area for storing replacement blades 5. Any one of the numerous spare or used blade storage approaches known in the art may be used. By way of no-limiting example, the utility knife 10 may include a storage arm 14 that pivots in and out of a rear portion of the top 21 of housing 20 and is configured to hold several spare blades 5. Such a pivoting storage arm 14 may include suitable detents or other means to prevent inadvertent opening, magnets to secure the spare blades, and other means known in the art to facilitate convenient spare blade storage.

The discussion above has assumed that the release button 80 and the locking mechanism 60 are properly aligned when the blade carriage 30 is at its forwardmost position. However, such is not required, and the relevant aligned position may be at some forward point along the carriage's travel prior to the forwardmost position, but this is believed to be an inferior arrangement.

While it is believed advantageous if the utility knife 10 of the present invention has housing halves 20*a*,20*b* that are not separable by the user, such is not required in all embodiments. For example, provisions can be made to allow the user to separate the housing halves 20*a*,20*b* if desired, such as by removal of screw 12.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A utility knife for holding a cutting blade having at least one retaining notch therein, comprising:

an outer housing having a forward opening;

a blade carriage having a blade-receiving bay; said blade carriage moveable in said housing to move said cutting blade disposed in said bay from a retracted position to a deployed position, said cutting blade extending through said forward opening in said deployed position;

a locking mechanism operative to releasably couple said cutting blade to said carriage; said locking mechanism connected to said carriage for movement therewith relative to said housing; said locking mechanism moveable between a locked position operative to couple said cutting blade to said carriage for movement therewith and an unlocked position wherein said cutting blade can be removed from said carriage; said locking mechanism biased toward said locked position;

said locking mechanism having a protrusion; said protrusion configured to engage the cutting blade's retaining notch in said locked position and disengage from said retaining notch in said unlocked position; said protrusion having an underside disposed toward the cutting blade when said cutting blade is disposed in said blade-receiving bay; and a first actuator moveably coupled to said housing and operative to engage with the underside of said protrusion and move said locking mechanism from said locked position to said unlocked position.

2. The utility knife of claim 1 further comprising a second actuator coupled to said carriage for movement therewith, said second actuator biased to an upward position for engaging said housing so as to retain said carriage in a selected horizontal position relative to said housing.

3. The utility knife of claim 1 wherein said first actuator mounts to a sidewall of said housing and moves generally vertically to engage said locking mechanism and move said locking mechanism from said locked position to said unlocked position.

4. The utility knife of claim 3 wherein said blade-receiving bay opens toward said first sidewall.

5. The utility knife of claim 1 wherein the cutting blade can be inserted into said blade-receiving bay via said forward opening.

6. A utility knife, comprising:

an outer housing having first and second lateral sidewalls and a forward opening;

a blade carriage having a blade-receiving bay opening toward said first sidewall; said blade carriage moveable in said housing to move a cutting blade disposed in said bay from a retracted position to a deployed position, said cutting blade extending through said forward opening in said deployed position;

a locking mechanism operative to releasably couple said cutting blade to said carriage; said locking mechanism connected to said carriage for movement therewith relative to said housing; said locking mechanism moveable generally parallel to and generally along the plane of said cutting blade between a locked position operative to couple said cutting blade to said carriage for movement therewith and an unlocked position wherein said cutting blade can be removed from said carriage; said locking mechanism biased toward said locked position; and a first actuator moveably mounted to said first sidewall of said housing; said first actuator moveable generally parallel to said cutting blade to engage said locking mechanism and move said locking mechanism from said locked position to said unlocked position.

7. The utility knife of claim 6 further comprising a second actuator coupled to said carriage for movement therewith, said second actuator biased to an upward position for engaging said housing so as to retain said carriage in a selected horizontal position relative to said housing.

8. The utility knife of claim 6 wherein said housing further comprises a top and a bottom, said first and second lateral sidewalls extending between said top and said bottom; said sidewalls being longer than said top and said bottom; and wherein a second actuator for controlling movement of said carriage is associated with said top.

9. The utility knife of claim 8 wherein said first actuator is disposed closer to said top than said bottom when said locking mechanism is in said unlocked position.

10. The utility knife of claim 6 wherein the cutting blade can be inserted into said blade-receiving bay via said forward opening.

11. A utility knife, comprising:

an outer housing having a forward opening;

a blade carriage having a blade-receiving bay; said blade carriage moveable in said housing to move a cutting blade disposed in said bay from a retracted position to a deployed position, said cutting blade extending through said forward opening in said deployed position;

a locking mechanism operative to releasably couple said cutting blade to said carriage; said locking mechanism connected to said carriage for movement therewith relative to said housing; said locking mechanism moveable generally parallel to said cutting blade between a locked position operative to couple said cutting blade to said carriage for movement therewith and an unlocked position wherein said culling blade can be removed from said carriage; said looking mechanism biased toward said locked position;

a first actuator moveable a first distance, when aligned with said locking mechanism, to engage said locking mechanism and move said locking mechanism from said locked position to said unlocked position; said first actuator moveable not more than a second distance when not aligned with said locking mechanism, said second distance shorter than said first distance.

12. The utility knife of claim 11 further comprising a second actuator coupled to said carriage for movement therewith, said second actuator biased to an upward position for engaging said housing so as to retain said carriage in a selected horizontal position relative to said housing.

13. The utility knife of claim 11 wherein said housing further comprises a top, a bottom, and first and second lateral sidewalls extending between said top and said bottom; said sidewalls being longer than said top and said bottom; and wherein a second actuator for controlling movement of said carriage is associated with said top.

14. The utility knife of claim 13 wherein said first actuator is disposed closer to said top than said bottom when said locking mechanism is in said unlocked position.

15. The utility knife of claim 11 wherein said first actuator moves generally vertically to engage said locking mechanism and move said locking mechanism from said locked position to said unlocked position.

* * * * *